United States Patent [19]

Muto et al.

[11] Patent Number: 4,848,691

[45] Date of Patent: Jul. 18, 1989

[54] APPARATUS FOR SPLICING A REPLACEMENT WEB TO A MOVING WEB

[75] Inventors: Yoshiyuki Muto; Kouzou Sakakibara, both of Tokyo; Yasuo Iwata; Shigesaburo Chiba, both of Chiba, all of Japan

[73] Assignees: Tokyo Automatic Machinery Works, Ltd.; Japan Tobacco Inc., both of Tokyo, Japan

[21] Appl. No.: 133,350

[22] Filed: Dec. 15, 1987

[30] Foreign Application Priority Data

Dec. 25, 1986 [JP] Japan ..... 61-312564

[51] Int. Cl.[4] ..... B65H 19/18

[52] U.S. Cl. ..... 242/58.1; 156/504; 156/506

[58] Field of Search ..... 242/58.1, 58.2, 58.3, 242/58.4, 58.5, 78.8; 156/504, 506, 159

[56] References Cited

U.S. PATENT DOCUMENTS

| | | | |
|---|---|---|---|
| 3,939,031 | 2/1976 | Takimoto | 242/58.3 |
| 4,450,039 | 5/1984 | Salvucci et al. | 242/58.2 |
| 4,612,080 | 9/1986 | Aivola et al. | 242/58.1 |
| 4,646,986 | 3/1987 | Heitmann | 242/58.1 |

*Primary Examiner*—John M. Jillions
*Assistant Examiner*—John M. Eghtessad
*Attorney, Agent, or Firm*—Sandler & Greenblum

[57] ABSTRACT

Apparatus for splicing a replacement web to a moving web comprises a guide for guiding the moving web along a predetermined path. A cutter severs a portion of the replacement web to establish the leading edge thereof; and a splicing station is positioned in the path of movement of the moving web for splicing the leading edge of the replacement web to the moving web while the latter is moving.

The splicing station, which is constructed and arranged to establish a lap joint between the leading edge of the replacement web and the moving web, comprises a delivery device that includes a splice strip having adhesive on one surface, a device for positioning the strip in a direction perpendicular to the direction of the moving web, and a device for moving the replacement web in a direction perpendicular to the direction of the strip and into engagement with the adhesive surface of the strip in such a way that about half the width of the strip is covered by the leading edge of the replacement web which adheres to the strip, and the other half of the strip is uncovered exposing the adhesive. Finally, a device is provided for moving the strip and the replacement web adhered thereto relative to the moving web such that the exposed adhesive on the surface of the strip engages the moving web which is thereby adhered to the strip.

16 Claims, 11 Drawing Sheets

APPARATUS FOR SPLICING A REPLACEMENT WEB TO A MOVING WEB

TECHNICAL FIELD

This invention relates to apparatus for splicing a replacement web to a moving web used in automatic packaging equipment.

BACKGROUND ART

Relatively thin, soft packaging material such as cellophane, polypropylene, etc., is conventionally used to package many products such as cigarettes and the like. To facilitate the use of automatic packaging equipment, the packaging material is usually supplied in the form of a web which moves from a storage reel, on which the web is spooled, along a predetermined path to the packaging equipment in accordance with the operation of a feed roller. When the reel becomes empty, the web in a replacement reel is fed, usually by hand, into the feed roller, so that the operation of the packaging equipment can continue.

As the speed of packaging equipment increases, and as the equipment becomes more complex, the frequency of reel replacement also increases as does the difficulty in making a manual replacement of the web. Accordingly, it is an object of the present invention to provide a new and improved apparatus for automatically replacing a web used in automatic packaging equipment.

DISCLOSURE OF INVENTION

The present invention provides apparatus for splicing a replacement web to a moving web and comprises guide means for guiding the moving web along a predetermined path. Cutter means are provided for severing a portion of the replacement web to establish the leading edge thereof; and a splicing station is positioned in the path of movement of the moving web for splicing the leading edge of the replacement web to the moving web while the latter is moving.

In the preferred embodiment of the invention, the splicing station is constructed and arranged to establish a lap joint between the leading edge of the replacement web and the moving web. Preferably, the splicing station comprises a delivery device that includes a splice strip having adhesive on one surface, means for positioning the strip in a direction perpendicular to the direction of the moving web, and means for moving the replacement web in a direction perpendicular to the direction of the strip and into engagement with the adhesive surface of the strip in such a way that about half the width of the strip is covered by the leading edge of the replacement web which adheres to the strip, and the other half of the strip is uncovered exposing the adhesive. Finally, means are provided for moving the strip and the replacement web adhered thereto relative to the moving web such that the exposed adhesive on the surface of the strip engages the moving web which is thereby adhered to the strip.

The replacement web may be contained on a replacement reel onto which the replacement web is spooled, the replacement web having a free end to which a leader is attached. The leader may be provided with an adhesive portion for releasably engaging the web when the leader is wrapped around the spooled web in order to prevent unspooling thereof. The leader terminates in a tip that projects from the web when the leader is adhesively attached to the web. A leader tip nipping mechanism may be provided for selectively gripping the leader and unspooling a length of replacement web from the replacement reel into a closed loop by which a web drawing out mechanism is cooperable for unspooling a length of replacement web from the replacement reel. A supply delivery mechanism is provided for severing the length of web downstream of its capture for separating the loop from the remainder of the replacement web and defining the leading edge for the replacement loop.

BRIEF DESCRIPTION OF THE DRAWINGS

An embodiment of the present invention is shown in the accompanying drawings wherein.

BEST MODE FOR CARRYING OUT THE INVENTION

Figure 1:
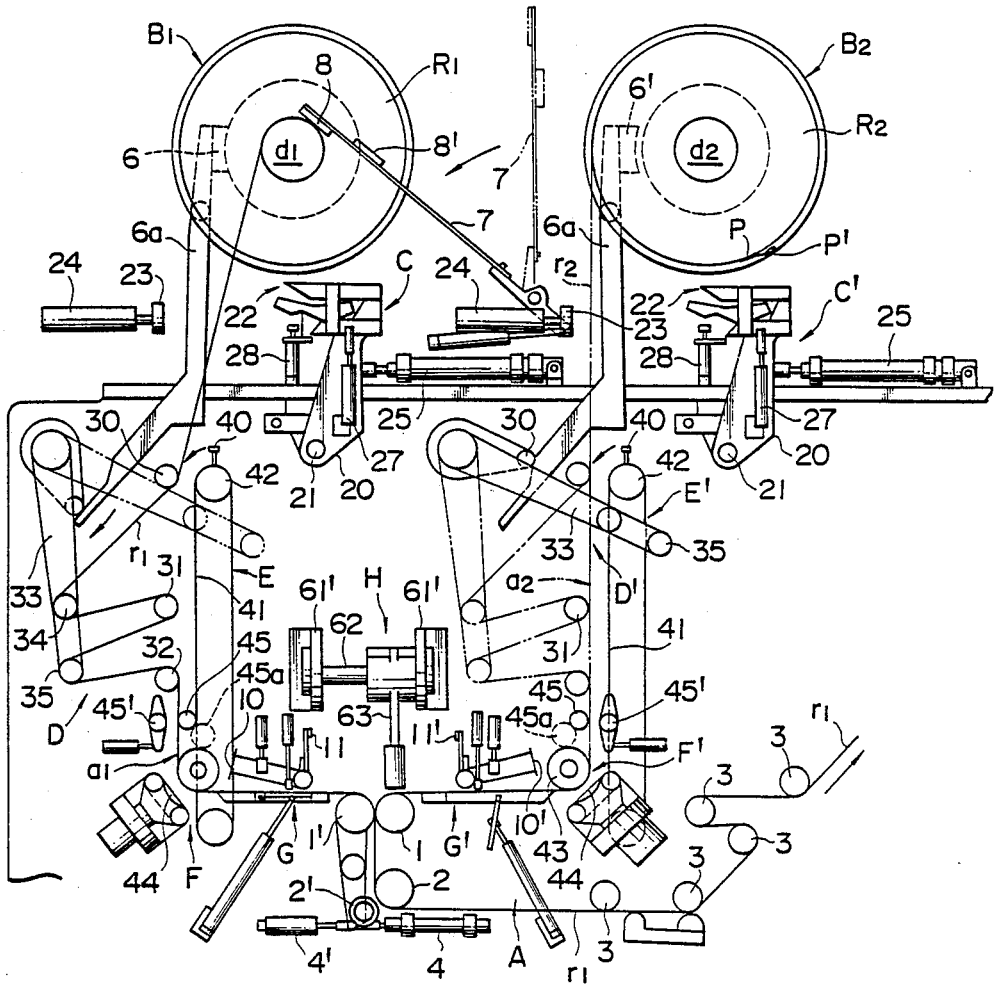
FIG. 1 is a front schematic view of apparatus according to the present invention.
Figure 10:
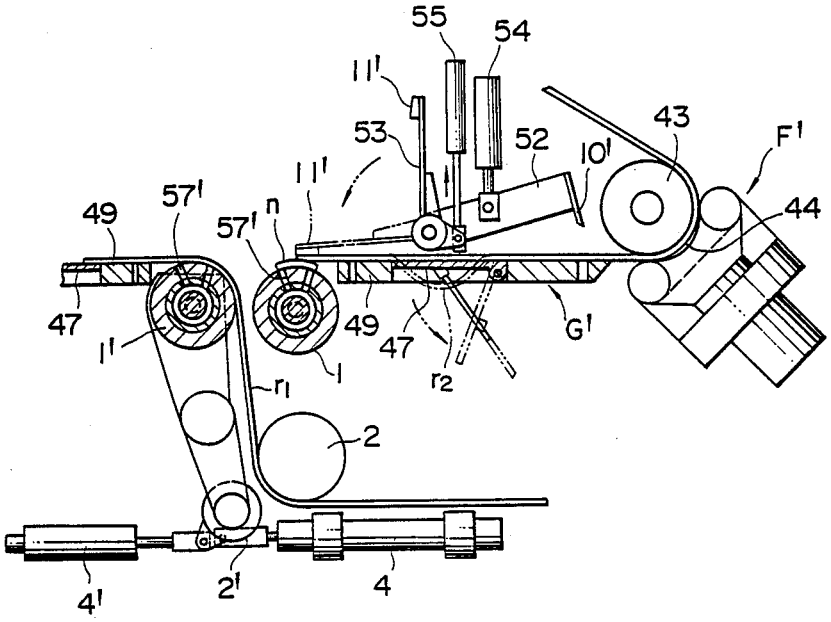
FIG. 10 is a view like FIG. 9, but showing how the leading edge of the replacement web is adhered to a splice strip.
Figure 11:
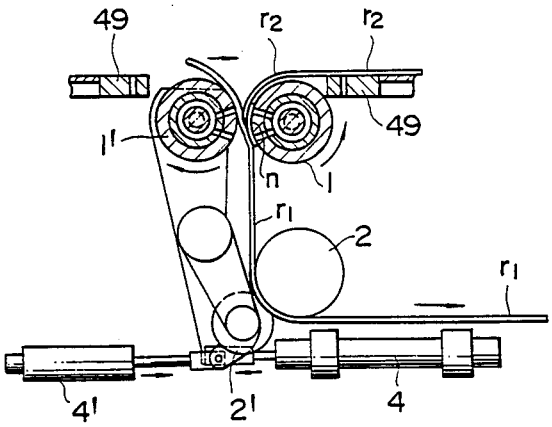
FIG. 11 is a view similar to FIG. 10 but showing the manner in which the splice takes place.

35 Before describing the apparatus of the present invention in detail, reference is made to FIG. 1 for the purpose of providing a brief overview of the apparatus. Referring to FIG. 1, reference numerals $B_1$, $B_2$ represent reel or bobbin holders having respective shafts $b_1$, $b_2$ for holding reels $R_1$, $R_2$ of a web material that is to be furnished to an automatic packaging machine (not shown). Reel $R_1$ on holder $B_1$ supplies web $r_l$ along a predetermined path $a_1$ by reason of vertical guide D and horizontal guide G to gripper roller 1' and delivery roller 2 before web $r_1$ engages rollers 3 leading to an automated packaging line (not shown). Eventually, the web spooled on reel $R_1$ will be depleted; and, in a conventional manner, a marker may be provided on the web near its connection with the hub $d_1$ of the reel for the purpose of indicating when the reel is about to be exhausted. A detector (not shown) detects this marker and actuates cutter 10 for the purpose of severing the moving web in preparation for splicing the leader edge of a replacement web to the trailing edge of the original web. Reference is made to FIGS. 10 and 11 for the purpose of showing how web $r_1$, as drawn to the packaging equipment, travels along guide G until the trailing edge engages gripper roll 1'.

According to the present invention, the leading edge of a replacement web partially overlies and is attached to pressure-sensitive tape n releasably held on gripper roller 1; and the gripper rollers 1, 1' move relative to each other so that, as shown in FIG. 11, the trailing end of the moving web and tape n are sandwiched between the gripper rollers. This sandwiching action presses the moving web into engagement with adhesive on the surface of tape n thereby splicing web $r_2$ to web $r_1$ while web $r_1$ is moving.

In addition to the pair of reels $R_1$, $R_2$ separately mounted for rotation on a frame, and the webs $r_1$, $r_2$ separately spooled on each reel, the apparatus of the present invention includes guides D, D' associated with the respective reels. These guides direct the respective webs along separate L-shaped paths each having legs defined by guides G, G' that terminates in gripper rollers 1, 1' whose axes are parallel to each other but perpendicular to the path of movement of webs $r_1$, $r_2$. The guides are constructed and arranged so that the leg of one path, namely guide G is aligned with the leg, namely guide G', of the other path, and the gripper rollers are adjacent each other. Because the L-shaped paths guides of the invention are identical, only the left path shown in FIG. 1 is described in detail.

Figure 2:
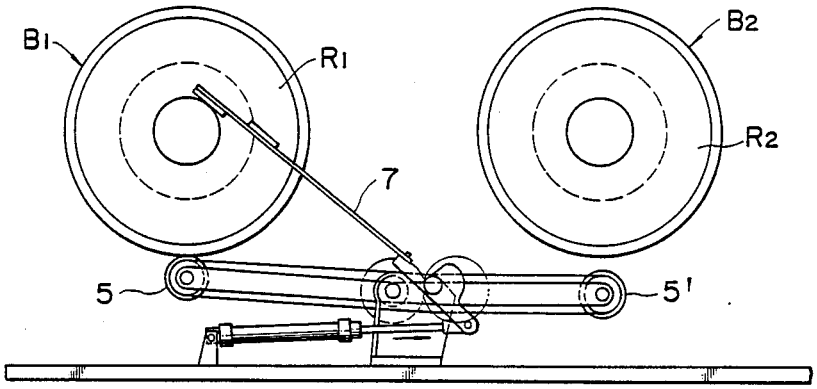
FIG. 2 is a front view of two reels, mounted on the apparatus, and a mechanism for use when a reel is exhausted.

As shown in FIG. 1, guide rollers 30, 31 and 32 are rotatably mounted on the frame of the apparatus and are engaged by moving web $r_1$. Tension on web $r_1$ is maintained by tension lever 33 which is pivotally mounted on the frame and carries rotatable tensions rollers 34, 35. Rigidly attached to tension lever 33 is a cam that engages the free end of brake arm **6*a* which is pivotally mounted on the frame and includes brake 6 that carries a brake shoe frictionally engageable with reel $R_1$ mounted. In its operative position shown in FIG. 1, left tension lever 33 maintains a tension on web $r_1$ as brake 6 engages the reel allowing moving web $r_1$ to be unspooled from this reel without looping. When tension lever 33 is rotated to the position shown in chain lines, the brake is released freeing the reel for movement After the marker on web $r_1$ is detected, as described above, and cutter 10 operates to sever web $r_1$, the apparatus shown in FIG. 2 comes into operation. In such apparatus, an actuator moves driving roller 5 into engagement with the periphery of holder $B_1$ for the purpose of rewinding the remnant of the web attached to the reel after cutter 10 has severed the web. After such rewinding occurs, an actuator is operated for the purpose of moving windback lever 7 into the position shown in FIG. 2 such that an electrically heated pad on the free end of lever 7 engages the web wound onto the hub of reel R1 thereby sealing the web remnant to itself and preventing its unwinding. The reel may now be removed from the apparatus and replaced by a fresh, full reel in preparation for its use in the manner described below. As shown in FIG. 2, driving roller 5' can be positioned to engage holder $B_2$ for the purpose of rewinding a web remnant onto reel R2 when that reel becomes exhausted In a manner similar to that described above, the windback lever 7 can be flipped to the right side as shown in FIG. 2 for the purpose of having an electrical heater engage the periphery of the web on reel R2** thus sealing the web to itself.

Figure 3:
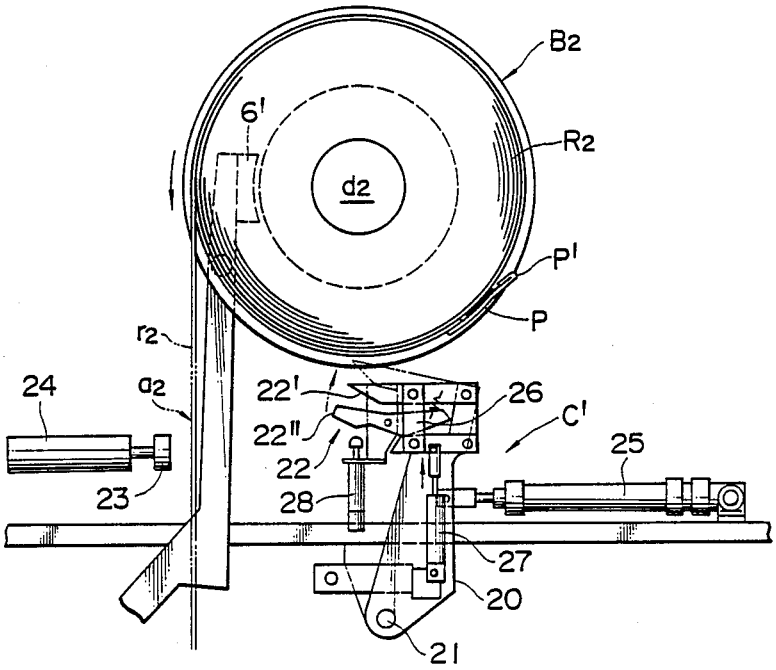
FIGS. 3–7 are sequential front views showing the process by which a replacement web is prepared for splicing to a moving web.

When reel R1 is supplying web to the packaging equipment in the manner shown in FIG. 1, reel R2 is a replacement reel carrying replacement web $r_2$, the free end of which will be spliced to the trailing end of web $r_1$ when reel R1 is depleted. Before describing in detail how the splice occurs, it is appropriate to describe how the replacement web is prepared for the splicing operation. Reference is now made to FIG. 3 which shows reel R2 carrying the replacement web mounted on holder $B_2$. In order to move the replacement reel onto holder $B_2$, tension lever 33 is rotated to the position shown in solid lines in FIG. 1 releasing brake 6' from engagement with reel R2.

As placed on bobbin $B_2$, reel R2 contains replacement web $r_2$ spooled thereon. The free end of web $r_2$ has a leader attached which terminates in tip P' which projects from the web when the latter is spooled on reel R2. Associated with the leader is adhesive tape P interposed between the leader and the outer web on the reel for the purpose of releasably holding the leader to the web and preventing unspooling of the web. As a consequence of this construction, the rotation of reel R2 will cause tip P' to trace out a circular path around the center of rotation of the reel.

Figure 4:
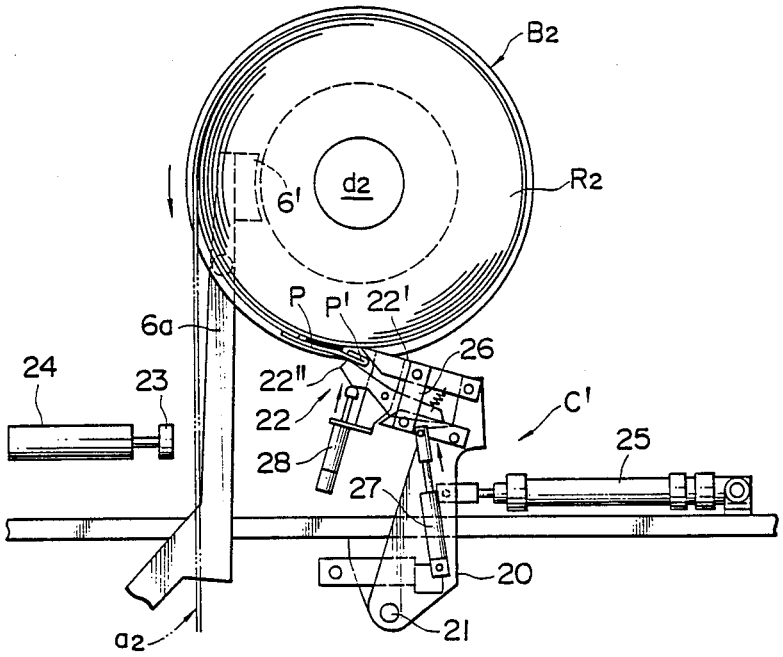
Figure 5:
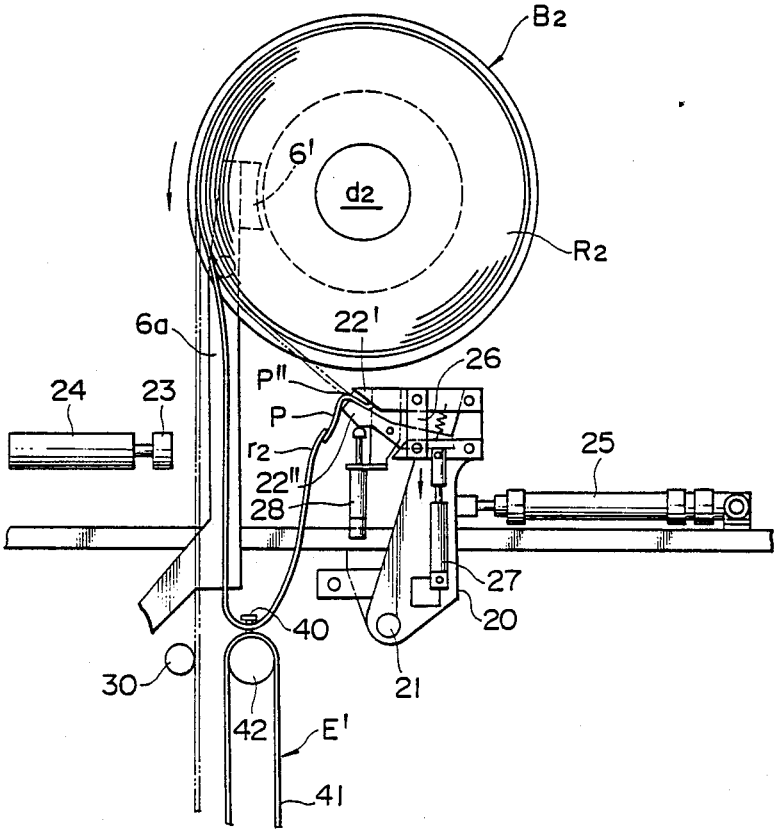
Figure 6:
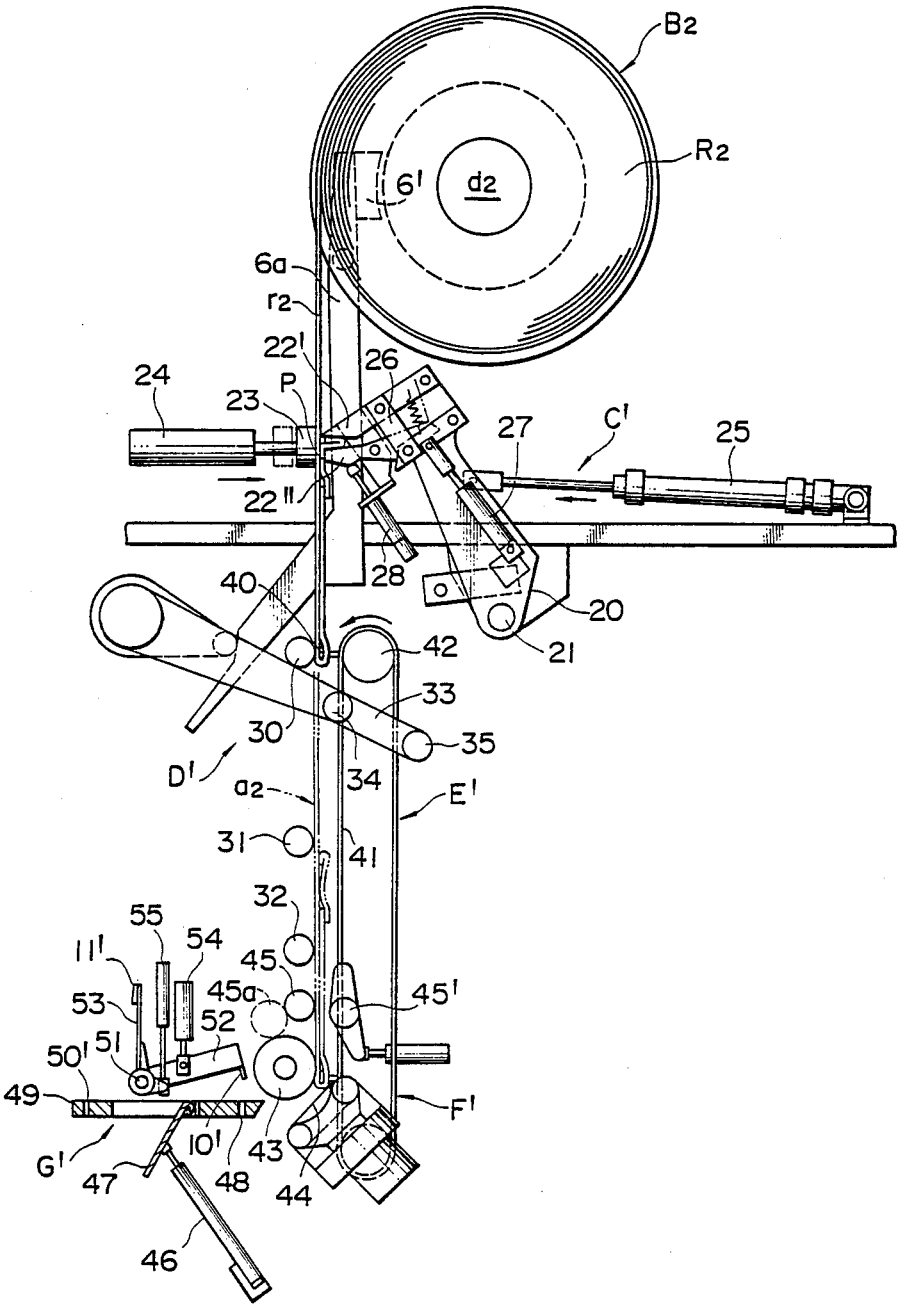

Leader tip nipping mechanism C' (FIG. 3) is provided for engaging the projecting lead tip P' and removing the leader on replacement web $r_2$. Mechanism C' includes arm lever 20 pivotally mounted to the frame at 21 carrying at its remote end a pair of jaws 22 in the form of upper jaw 22' and lower jaw 22" pivotally mounted on the arm. By operating air cylinder 27 attached to strap 26 on which the jaws are mounted, the jaws are tilted upwardly from the solid lines shown in FIG. 3 to the broken lines shown in that figure. As tip P' moves in a circular path about the center of rotation of reel R2, the tip eventually is engaged by upper jaw 22' as shown in FIG. 4. Actuation of cylinder 28 closes lower jaw 22" and captures the tip between the two jaws. Thereafter, air cylinder 27 is deactuated to the position shown in FIG. 5 as further rotation of reel R2 is terminated. The downward tilting of jaw 22 to the position shown in FIG. 5 is accompanied by a release of the tape P and the removal of the leader from attachment to the remainder of the web on reel R2. The residual rotation of reel R2 causes web $r_2$ to form an open loop as shown in FIG. 5. The lower end of this loop projects downwardly toward web drawing-out mechanism E'. This mechanism includes endless belt 41 vertically arranged and mounted on rollers 42 for limited movement in opposite directions. Carried on belt 41 is an arm that supports air cylinder 40' carrying piston rod 40. When this air cylinder is unactuated and rod 40 is retracted, the bottom end of the loop shown in FIG. 5 engages endless belt 41. When cylinder 40' is actuated, rod 40 extends outwardly (i.e., perpendicular to the paper as shown in FIG. 5) and engages the bottom of the loop. At this point, rotation of roller 42 carries the air cylinder and rod to the position shown in FIG. 6. At the same time, cylinder 25 is actuated causing jaws 22 to move the leader attached to replacement web $r_2$ into engagement with the web against anvil 23 which is pressed into engagement with the web by actuation of air cylinder 24 as shown in FIG. 6. Thus, adhesive P engages the web which forms a closed loop as shown in FIG. 6.

In this position of the closed loop, tension lever 33 is in the position shown in solid lines in FIG. 6 allowing continued rotation of belt 41 to draw web $r_2$ along path $a_2$ to the left of tension roller 34 but to the right of guide rollers 30, 31, 32 to the position shown in chain lines in this figure. At this point, namely when rod 40 is located adjacent supplemental delivery roller 43, air cylinder 40' is deactuated withdrawing rod 40 from the closed loop. Meanwhile, the closed end of this loop is captured between roller 43 and guide belt 44 of supplementary delivery mechanism F'.

Figure 7:
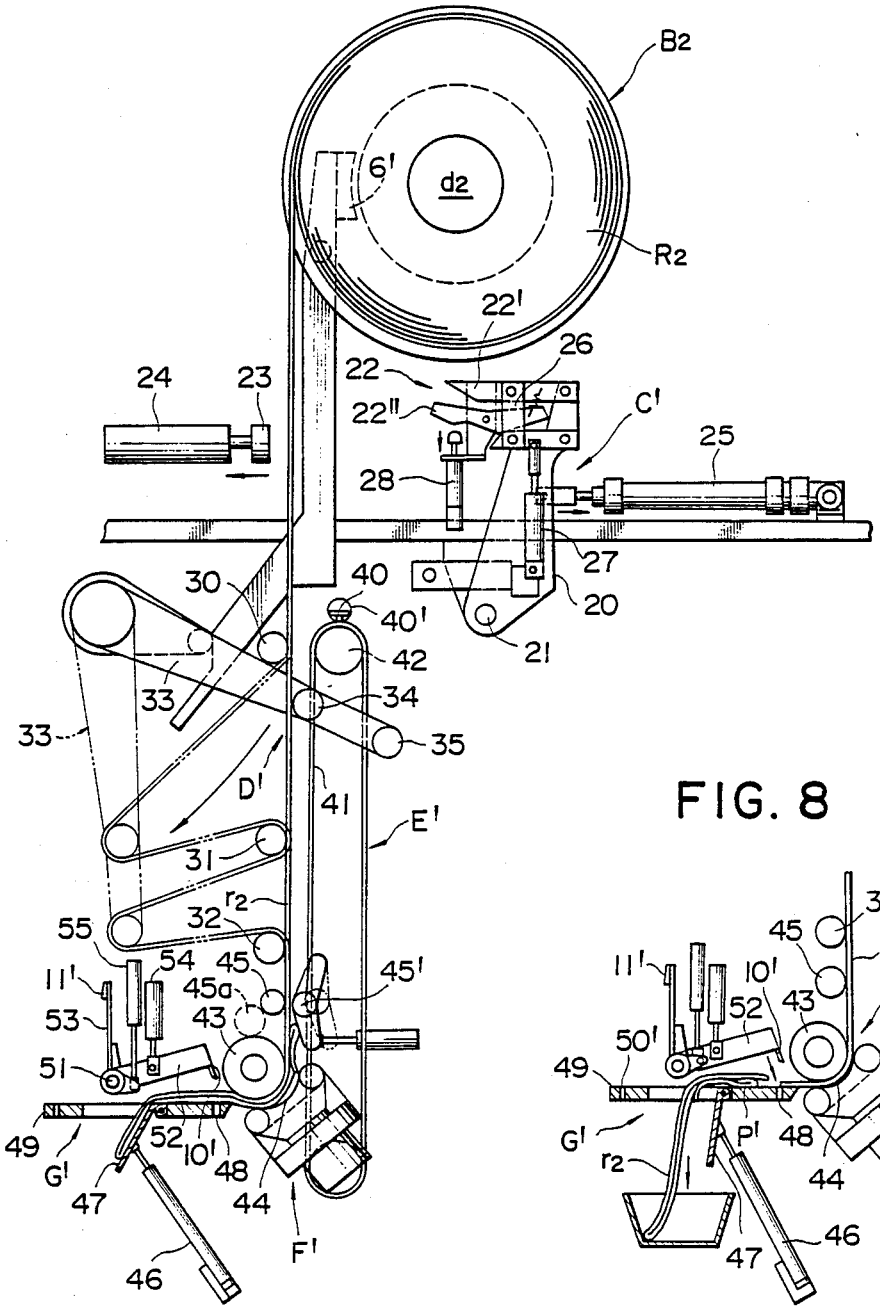

In order to move replacement web $r_2$ around roller 43, supplemental roller 45, movable roller 45', and transmission mechanism **45*a* are utilized. As indicated in FIG. 6, the replacement web engages rollers 45 and 43 and also belt 44. To ensure proper movement, roller 45' is moved into engagement with the web pressing the same against roller 45 as shown in FIG. 7. By powering transmission mechanism 45*a*, the loop at the end of web $r_2$ will be drawn around roller 43 and onto horizontal bottom guide 49 of guide mechanism G'. This is indicated in FIG. 7**.

Figure 8:
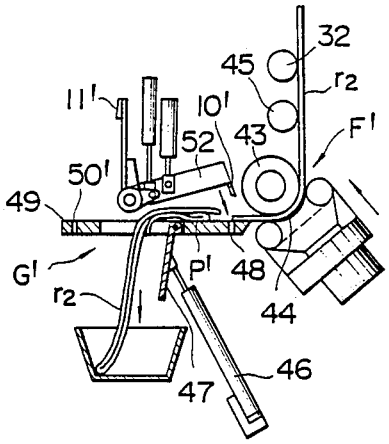
FIG. 8 is a front view, with parts partly broken away, showing apparatus concerned with establishing the leading edge of the replacement web.
Figure 9:
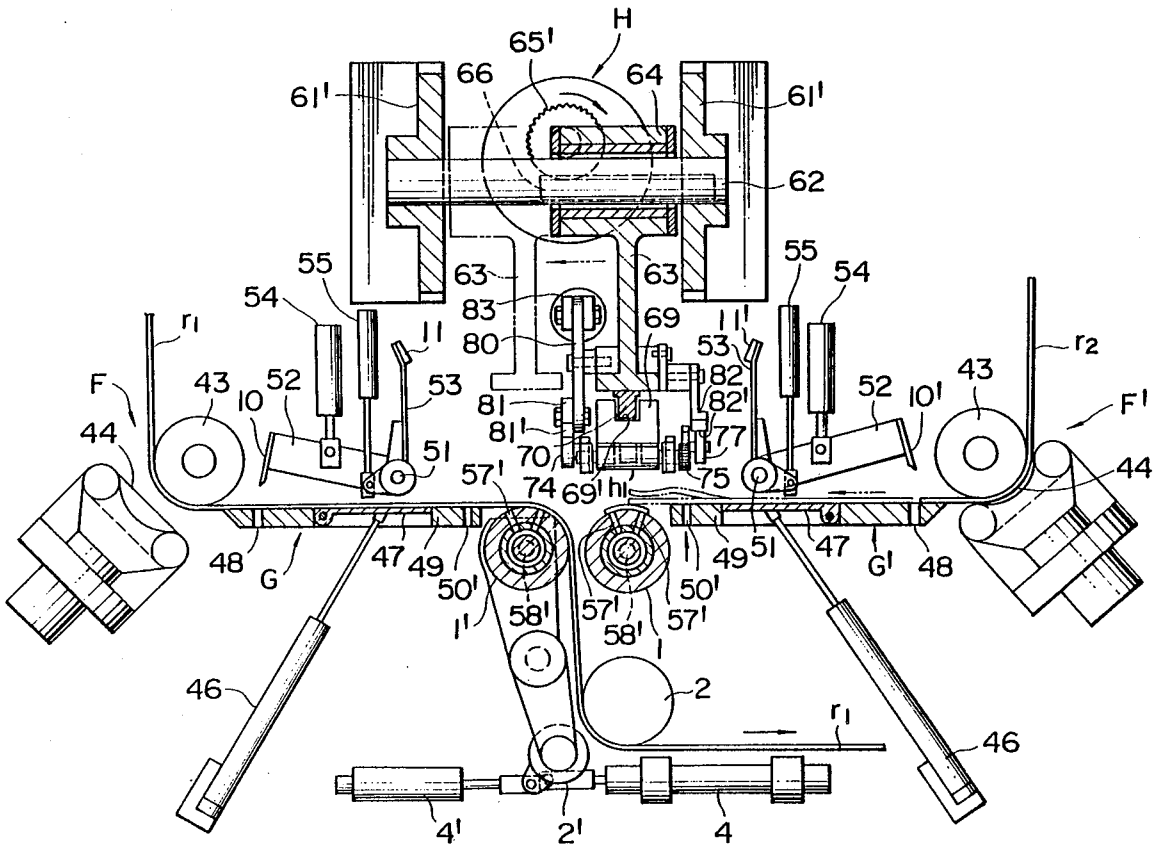
FIG. 9 is a front view matching the view shown in FIG. 1, but taken along the line IX—IX of FIG. 12, detailing the manner in which the leading edge of a replacement web is prepared for splicing to a moving web.

Bottom guide 49 is provided with an aperture closed by hinged plate 47 the position of which is controlled by air cylinder 46. When the leading end of the closed loop is fed past roller 43 by the operation of transmission **45*a*, cylinder 46 is actuated to move plate 47 to the position shown in FIG. 7 allowing the closed loop to be diverted from guide 49 as the replacement web is unspooled from reel R2. Eventually, the leader is fed past roller 43 to the position shown in FIG. 8 whereupon actuation of air cylinder 54 moves arm 52 clockwise as shown in FIGS. 7 and 8 allowing cutter 10' to sever web $r_2$ as cutter 10' enters recess 48 in bottom guide 49. In this manner, the closed loop at the free end of web $r_2$ is detached from the web thereby establishing a leading edge on replacement web $r_2$ as shown in FIG. 8. As described in below, continued operation of transmission mechanism 45*a* will move the leading edge of replacement web $r_2$ toward gripper roller 1 at the free end of guide 49. Before the free end reaches this gripper roller, however, adhesive tape delivery system H, in the manner described below, is effective to place a tape strip n on roller 1 as shown in FIG. 10. This strip is as long as web $r_2$ and the operation of transmission mechanism 45*a* is such that, in conjunction with the application of a jet of air through aperture 50' the free edge of replacement web $r_2$ is positioned approximately half-way across the width of tape n and in engagement with adhesive covering the upper surface of this tape. This is illustrated in FIGS. 9 and 10; and upon actuation of cylinder 55, pressure finger 11' is moved from the position shown in solid lines in FIG. 10 to the position shown in chain lines in this figure into engagement with the replacement web thus causing the free end of the replacement web to be adhered to the pressure-sensitive tape. The apparatus described in connection with FIGS. 9 and 10 is then terminated while the apparatus continues to feed the moving tape from reel $R_1$ to the packaging equipment. Further, action to carry out the splicing operation follows upon detection of a marker on the moving web in the manner described above. This operation will be described in detail after an explanation is given of the manner in which tape n is positioned on gripper roller 1**.

Figure 12:
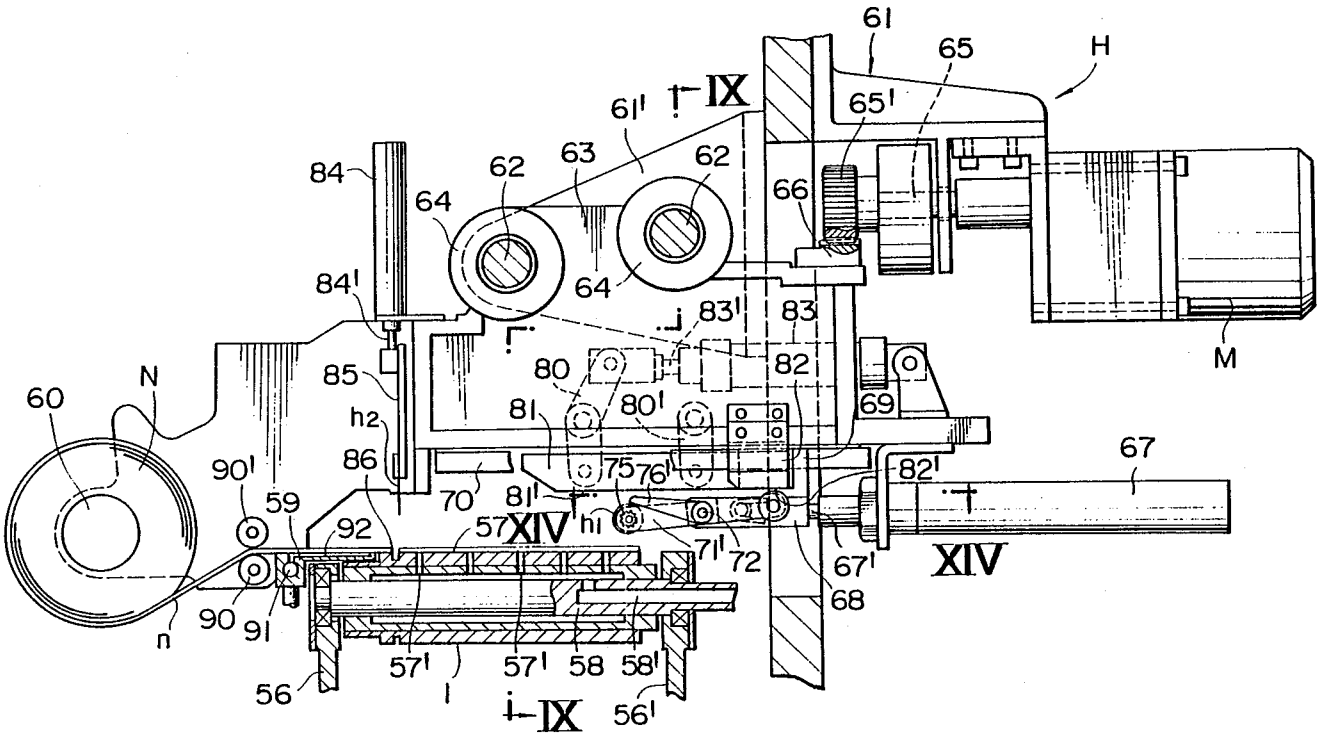
FIG. 12 is a side elevation of a splice tape delivery system according to the present invention showing the splice tape about to be withdrawn from a roll.

As shown in FIG. 12, main frame 61 of the apparatus is provided with a pair of spaced sidewalls 61' (see FIG. 9) projecting in a direction perpendicular to the direction of movement of the webs on bottom guides 48 and 49. A pair of guide rods 62 are mounted between sidewalls 61' for supporting hub portions 64 carrying flange 63 to which guide 70 is attached. Guide 70 guides U-shaped frame 68 provided with slot 69' that fits slidingly around guide 70. Frame 68 is rigidly connected to rod 67' associated with air cylinder 67. When this cylinder is in its unactuated state, frame 68 occupies the position shown in FIG. 12; and when cylinder 67 is actuated, frame 68 is extended to the position shown in FIG. 13.

Rigidly attached to flange 63 and extending in a direction perpendicular to the direction of rod 67' is rack 66 engaged with pinion 65' attached to motor shaft 65 carried by motor M which is rigidly connected to frame 61. The axis of motor M is parallel to the axis of actuator 67 with the result that selective rotation of this motor will move flange 63 in the same direction that the webs move on guides 48, 49 from the position shown in solid lines in FIG. 9 to the chain lines shown in this figure. Reverse rotation of the motor will move the flange in the opposite direction. In this manner, frame 68 may be positioned over either gripper roller 1 as shown in FIG. 9, or over gripper roller 1'.

When web $r_1$ is the moving web and is being furnished to the packaging equipment, motor M is energized to move frame 63 to the position shown in FIG. 9 where frame 68 is positioned above gripper roller 1. In this position, pressure-sensitive tape delivery system H is positioned so that tape n from reel N mounted on guide 60 (FIG. 13) can be unspooled onto gripper roller 1. Tape n comprises a substrate bearing an adhesive on its upper surface. Thus, as shown in FIG. 12, the tape may be threaded manually between feed rollers 90, 90' and into engagement with a table carrying groove 92 connected to suction line 91. Thus, an operator may manually position tape n as shown in FIG. 12, the tape being held in this position with the free end, reaching to groove 86 in gripper roller 1, by the suction applied to groove 92. Frame 68 is provided with drawing-out roller $h_1$ for the purpose of engaging the adhesive surface on tape n, drawing the tape to the right as shown in FIG. 12 across gripper roll 1 as shown by the chain lines in this figure. This operation is illustrated schematically in FIG. 16 to which reference should be made in connection with the discussion of FIGS. 12 and 13.

Figure 13:
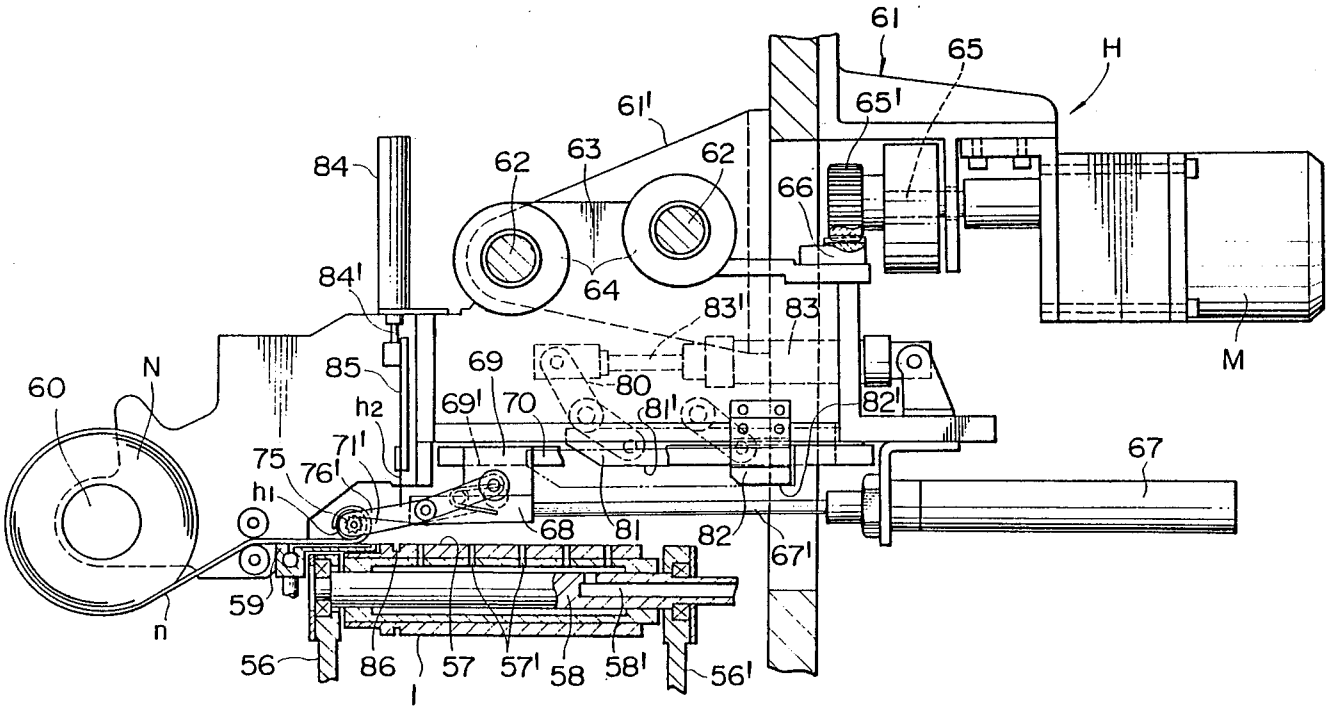
FIG. 13 is a view similar to FIG. 12 but showing the splice tape abut to be unspooled from the roll of tape.
Figure 14:
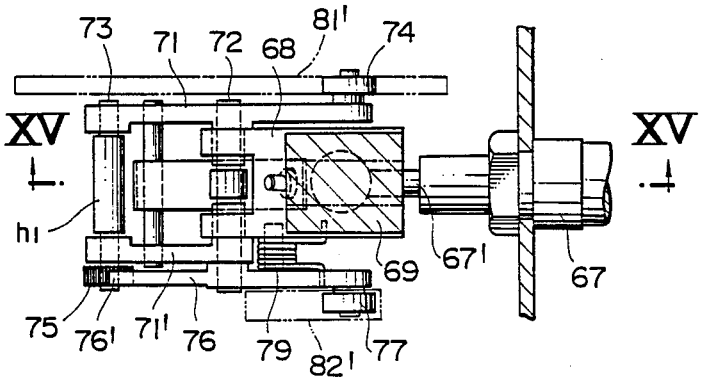
FIG. 14 is a view partially in section taken along the line XIV—XIV in FIG. 12 and showing details of a drawing-out roller associated with the tape delivery device.
Figure 15:
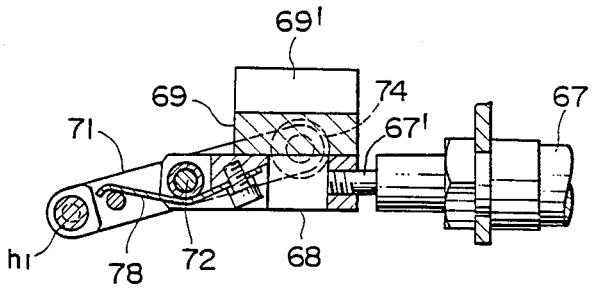
FIG. 15 is a sectional view taken along the line XV—XV of FIG. 14.

Drawing-out roller $h_1$ has axial ends 73 (FIG. 14) which are rotatably mounted in arms 71, 71' which themselves are pivoted at 72 to frame 68. Leaf spring 78 attached to frame 68 and passing around pivot pin 72 engages a pin adjacent roller $h_1$ and biases this roller in a counterclockwise direction as seen in FIGS. 12, 13 and 15.

Rigidly attached to shaft 73 is ratchet wheel 75 such that both roller $h_1$ and ratchet wheel 75 turn together. Engaged with ratchet wheel 75 is tip 76' of pawl 76 which is pivotally mounted on an extension to pin 72 as shown in FIG. 14. On the end of pawl 76 opposite tip 76' is cam roller 77 which is engageable with cam surface 82' on cam 82 rigidly connected to flange 63. The position of cam surface 82 with respect to cam follower 77 is such that when follower 77 is engaged with surface 82', pawl 76 is rotated such that tip 76' is out of engagement with ratchet wheel 75. Thus, roller $h_1$ is free to rotate in both directions in this position of frame 68. On the other hand, when the frame is moved by the actuation of air cylinder 67 until cam follower 77 disengages cam 82', tip 76' engages ratchet wheel 76 and prevents rotation of roller hl in a clockwise direction as viewed in FIGS. 12 and 13. However, the ratchet and pawl connection is such as to permit counterclockwise rotation of the roller.

Arm 71, which provides a rotational mounting for pin 73, at one end of the arm, has an extension at the opposite end on which cam follower 74 is rotatably mounted. This cam follower is aligned with movable cam 81 that is suspended from flange 63 to one side thereof by bell crank 80 and link 80'. This mounting permits cam 81 to move both axially in the direction of flange 63 and transversely to this direction as shown in FIG. 13. That is to say, when air cylinder 83 having rod 83' attached thereto is actuated, bell crank 80 occupies the position shown in FIG. 13 and cam 81 is physically raised out of the path of engagement with cam follower 74. When air cylinder 83 is deactuated, bell crank 80 is pivoted clockwise as shown in FIG. 13 to the position shown in FIG. 12 thereby moving cam 81 from the position shown in solid lines in FIG. 13 to the chain lines shown in this figure. In the latter position of cam 81, cam follower 74 is engageable with cam 81 as frame 68 is moved thereby causing arm 71 to rotate about pivot 72 thus raising roller $h_1$ against the action of spring 78.

Before describing how roller $h_1$ is used to withdraw a strip of tape from reel N across gripper roller 1, the construction of this roller is described. As shown in FIG. 12, roller 1 comprises shaft 58 rotatably mounted on support frame 56, 56', the axis of this shaft being perpendicular to the direction of movement of the replacement tape and of the moving tape, and parallel to the direction in which tape n is withdrawn from reel N. Attached to shaft 58 is a hollow cylinder carrying on its periphery an outer cylinder that includes apertures 57' connected to the interior of the hollow sleeve and forming what is termed suction surface 57 on the periphery of roller 1. Suction passage 58' connects suction holes 57' to a vacuum source which selectively applies a vacuum for the purpose of releasably holding tape n to roller 1, when the tape is drawn across surface 57 by roller $h_1$.

Figure 16:
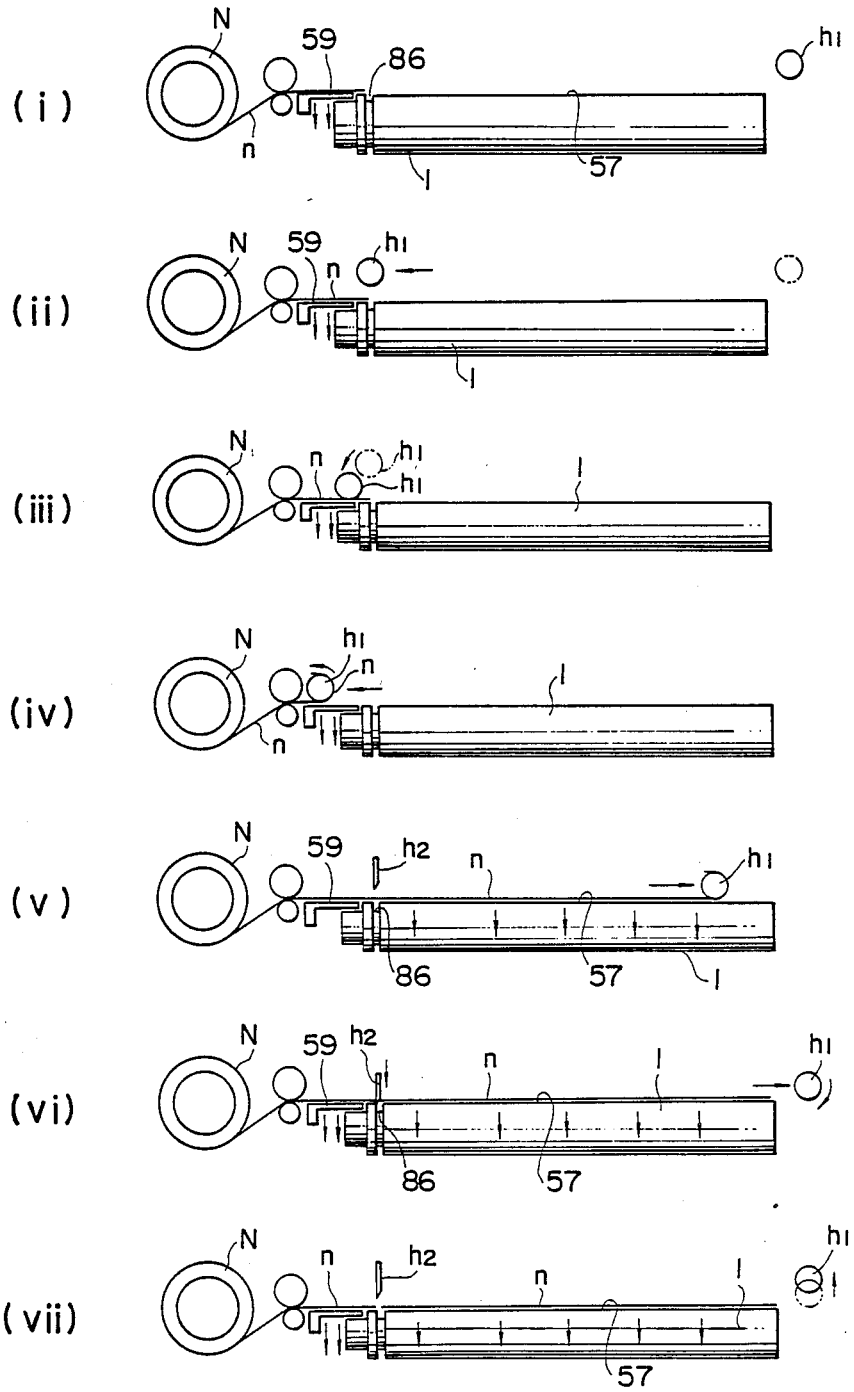
FIG. 16 is a schematic illustration showing the step-by-step operation by which the drawing-out roller extracts a length of tape from a roll thereof.

In operation, the various components of adhesive tape delivery system H occupy the position shown in FIG. 12 after tape n has been manually positioned as shown in this figure. Roller $h_1$ is located above surface 57 as indicated in FIG. 16(i), this position of roller $h_1$ being established because cam follower 74 is engaged with cam surface 81'. Actuation of cylinder 67 moves frame 68 to the left as shown in FIG. 12, roller $h_1$ remaining spaced above the level of surface 57 as shown in FIG. 16(ii) because cam follower 74 remains engaged with cam surface 81'. Further movement of rod 67' causes cam follower 74 to unseat from surface 81' allowing roller $h_1$to pivot counterclockwise as seen in FIG. 15 until the roller engages the adhesive surface on tape n as shown in FIG. 16(iii). The tacky nature of the upper surface of tape n causes the tape to adhere to roller $h_1$ under the resilient pressure effected by spring 78. At this point in the displacement of frame 68, cam follower 77 is disengaged from cam surface 82' with the result that pawl 76 engages ratchet wheel 75 which prevents clockwise rotation of roller $h_1$ as seen in FIG. 13 but permits counterclockwise rotation. As a consequence, further movement of rod 67' as air cylinder 67 is continued to be actuated, causes roller $h_1$ to rotate as rod 67' moves thereby rolling tape n around roller $h_1$ as indicated in FIG. 16(iv). Thus, the free end of tape n is securely attached to roller $h_1$; and, deactuation of cylinder 67 causes frame 68 to return to the right as seen in FIG. 13 drawing tape from roll N across surface 57. At this point in time, suction is applied to the surface and tape n is releasably held on the surface as roller $h_1$ moves to the right as shown in FIG. 16(v). The tape is withdrawn from reel N because the free end of the tape is wrapped around roller $h_1$ and the ratchet wheel prevents revisable rotation of the roller.

Just before roller $h_1$ reaches its rightmost terminal position as shown in FIG. 13, cam follower 77 on pawl 76 engages cam surface 82' thus pivoting the tip 76' of the pawl out of engagement with ratchet wheel 75 freeing roller $h_1$ for rotational movement. This occurs as rod 67' is withdrawn further into air cylinder 67 unwinding the free end of the tape end from the roller as the suction on roller 1 maintains the tape on suction surface 57. When the roller returns to its rightmost position, actuation of cylinder 83 causes bell crank 80 to pivot thereby moving cam surface 81' into engagement with cam follower 74 pivoting roller $h_1$ clockwise about pivot 72 and raising the roller above the surface of roller 1 as shown in FIG. 16(vii). Strip n has thus been positioned transversely to the direction of movement of the replacement web and its path as shown in FIG. 9. At this point, air cylinder 84 is actuated moving rod 84' downwardly as shown in FIG. 13 and causing blade $h_2$ to engage and sever from roll n the portion of the strip n lying on roller 1 as shown in FIG. 16(vi). Groove 86 provides clearance for blade $h_2$.

At this point, transmission 45*a* may be operated for the purpose of moving the leading edge of replacement web $r_2$ into engagement with strip n lying on roller 1. To facilitate this, an air jet may be applied to aperture 50' enabling the leading edge of the replacement web to overlie the strip on roller 1. As shown in FIG. 9, the leading edge of the replacement web covers about half the width of strip n. The other half of the width of strip n is uncovered exposing the adhesive on the strip. At this point, cylinder 55 is actuated causing finger 11' to engage the leading edge of the replacement web and press the same into tight contact with strip n thus adhering the leading edge to the strip.

Eventually, reel $R_1$ will be depleted and cutter 10 will be actuated to engage moving web $r_1$ establishing its trailing edge as described above. The trailing edge will continue to move until it reaches roller 1'. At this point, roller 1' is rotated clockwise and roller 1' is rotated counter-clockwise as seen in FIG. 11, and cylinder 4 is actuated thus pivoting roller 1' toward roller 1. The pivotal movement of roller 1 as suction is applied to parts 57', draws tape n toward web $r_1$ as the latter moves around roller 1'. The trailing end of web $r_1$ is thus pressed into engagement with the exposed adhesive on the half of tape n that is not covered by the leading end of replacement web $r_2$. Web $r_2$ is thus connected to web $r_1$ and is drawn therealong by the mechanism that pulls web $r_1$. To ensure proper contact between web $r_1$ and the adhesive on tape n, cylinder 4' is actuated to move roller 2' into engagement with roller 2 as the splice joint posses between rollers 2 and 2'.

Rollers 1 and 1' are thereafter returned to the positions shown in FIG. 10, and suction is applied to roller 1' in preparation for it to receive a strip of tape. In addition, motor M is actuated to move tape roll n from alignment with roller 1 into alignment with roller 1'. The process described above for withdrawing a strip of tape from roll n is then repeated, but the tape is laid out on roller 1 in preparation for receiving the leading edge of a new web on a new reel that replaces the exhausted reel on bobbin holder B1.

The advantages and improved requests furnished by the method and apparatus of the present invention are apparent from the foregoing description of the preferred embodiment of the invention. Various changes and modifications may be made without departing from the spirit and scope of the invention as described in the claim 1 that follows.

What is claimed is:

1. Apparatus for splicing a replacement web to a moving web comprising:

(a) guide means for guiding said moving web along a predetermined path;

(b) cutter means for severing a portion of said replacement web to establish the leading edge thereof; and (c) a splicing station positioned in said path for splicing said leading edge to said moving web while the latter is moving;

(d) said splicing station being constructed and arranged to establish a lap joint between the leading edge of said replacement web and said moving web;

(e) said splicing station comprising a delivery device that includes a strip of tape having pressure-sensitive adhesive on one surface means for positioning said strip in a direction perpendicular to the direction of said moving web, means for moving said replacement web in a direction perpendicular to the direction of said strip and into engagement with the adhesive surface of the strip in such a way that the leading edge of the replacement web covers about half of the width of the strip and adhered thereto, and means for thereafter moving said strip and the replacement web adhered there to relative to said moving web until the surface of said strip not covered by said replacement web engages the moving web which is thereby adhered to the strip

2. Apparatus according to claim 1 including:

(a) a reel for storing said moving web, said reel being unwound by the movement of the moving web;

(b) further cutter means upstream of said splicing station for severing said moving web to establish the trailing end thereof and to establish a free end to the remnant of web on the spool;

(c) rewinding means cooperable with said real for rewinding said free end onto said reel; and (d) means to adhere the free end of the web wound on the spool to the remainder of the web.

3. Apparatus according to claim 1 including:

(a) a replacement reel on which said replacement web is spooled for storing said replacement web which has a free end to which a leader is attached; said leader having pressure-sensitive adhesive for releasably engaging the web to prevent unspooling thereof and terminating in a tip that projects from the web when the layer is basically engaged with the web;

(b) a leader tip nipping mechanism for selectively gripping said leader and unspooling a length of replacement web from said replacement reel into a closed loop;

(c) a web drawing out mechanism cooperable with said loop for capturing said replacement web upstream of said loop; and (d) a supply delivery mechanism for unspooling said web from said reel and severing said web downstream of its capture for separating said loop from the remainder of said replacement web and filing the leading edge thereof.

4. Apparatus for splicing a replacement web into a moving web comprising:

(a) guide and means for guiding said moving web along a predetermined path;

(b) cutter means for severing a portion of said replacement web to establish the leading edge thereof;

(c) a splicing station positioned in said path for splicing said leading edge to said moving web while the latter is moving;

(d) said splicing station being constructed and arranged to establish a lap joint between the leading edge of said replacement web and said moving web;

(e) said splicing station comprising a delivery device that includes a strip of tape having pressure-sensitive adhesive on one surface, means for positioning said strip in a direction perpendicular to the direction of said moving web, means for moving said replacement web in a direction perpendicular to the direction of said strip and into engagement with the adhesive surface of the strip in such a way that the leading edge of the replacement web covers about half of the width of the strip and is adhered there to, and means for hereafter moving said strip and the replacement web adhered there to relative to said moving web until the surface of said strip not covered by said replacement web engages the moving web which is thereby adhered to the strip;

(f) said strip being spooled on a reel and having a leading edge, and wherein said means for positioning said strip includes a rotatable drawing-out roller, means for displacing said roller from a first terminal position transversely to the direction of said moving web to a second terminal position and into engagement with said one surface at the leading edge of said strip, means for rotating said roller in said second terminal position to thereby releasably attach the same to said leading edge of said strip, means for displacing said roller towards its first terminal position thereby unspooling said strip and positioning the same transversely to the direction of said moving web, means engaged with said other surface of said strip for releasably holding the same, means to disengage said roller from said strip, and means to sever the strip from its spool to establish a trailing edge of the strip.

5. Apparatus according to claim 4 wherein said means engaged with the other surface of said strip include a first gripper roller whose axis is perpendicular to the direction of said moving web, and suction means associated with said first gripper roller for selectively retaining said strip thereto.

6. Apparatus according to claim 5 including means for severing an upstream portion of said web to establish the trailing end thereof.

7. Apparatus according to claim 5 including a second rotatable grip roller adapted to be engaged with said moving web, the axis of said rotatable gripper roller being parallel to the axis of said first gripper roller, adjustable means controlling the spacing between the gripper roller such that at one adjustment, the gripper rollers are separated, and in another adjustment, the gripper rollers are urged toward each other such that the moving web is sandwiched between said gripper rollers, and means for rotating said first gripper roller so that said adhesive surface of the strip not covered by said replacement web is pressed into engagement with a trailing end of said moving web thereby adhering the strip and the replacement web connected thereto to the moving web.

8. Apparatus for splicing a replacement web to a moving web comprising:

(a) guide means for guiding said moving web along a predetermined path;

(b) cutter means for severing a portion of said replacement web to establish the leading edge thereof;

(c) a splicing station positioned in said path for splicing said leading edge to said moving web while the latter is moving;

(d) a replacement reel on which said replacement web is spooled for storing said replacement web which has a free end to which a leader is attached; said leader having pressure-sensitive adhesive for releasably engaging the web to prevent unspooling thereof and terminating in a tip that projects from the web when the layer is basically engaged the web;

(e) a leader-tip-nipping mechanism for selectively gripping said leader and unspooling a length of replacement web from said replacement reel into a closed loop;

(f) a web drawing out mechanism cooperable with said loop for capturing said replacement web upstream of said loop;

(g) a supplementary delivery mechanism for unspooling said web from said reel and severing said web down stream of its capture from separating said loop from the remainder of said replacement web and filling the leading edge thereof; and (h) said leader-tip-nipping mechanism including means for rotating said reel; a movable arm having actuatable jaws; means for moving said arm until said jaws are positioned to intercept said tip as the reel is rotated; and means for actuating said jaws after said tip is intercepted for capturing said tip in said jaws.

9. Apparatus according to claim 8, including means for unspooling the replacement web from the replacement reel after said tip is captured to form an open loop, and means for moving said arm until adhesive on said leader is engaged with the replacement web thus forming a closed loop.

10. Apparatus according to claim 9, wherein said web drawing out mechanism includes a rod mounted for longitudinal movement along the axis of the rod which is transverse to the direction in which the replacement web is unspooled from said reel; means for longitudinally axially moving the rod into the closed loop; and means for moving the rod in a direction parallel to the direction in which the replacement web is unspooled from the reel; and means for withdrawing said rod from said loop.

11. Apparatus according to claim 10, wherein said supplementary delivery mechanism includes means for capturing said loop before the rod is withdrawn; and means for unspooling the web from the reel, said cutter means being a part of said supply delivery mechanism.

12. Apparatus comprising:

(a) a pair of reels separably mounted for rotation on a frame;

(b) a separate web spooled on each reel;

(c) a guide mechanism associated with each reel for guiding the web thereon along an L-shaped path having a leg that terminates in a grip roller whose axis is perpendicular to the path, the guide mechanism being constructed and arranged so that the leg of one path is aligned with the leg of the other path, and grip rollers are adjacent to each other and parallel;

(d) means for moving one web along one L-shaped path and over the grip roller thereon;

(e) a tape delivery device having a tape reel having tape spool thereon, said tape having pressuresensitive adhesive on one surface thereof, the axis of said tape reel being perpendicular to the axis of the grip rollers;

(f) said delivery device including means for selectively unspooling tape from said tape reel such that one surface of said tape faces upwardly and the other surface faces downwardly and into engagement with the gripper roller on the other L-shaped path, means for releasably retaining said tape to the last mentioned grip roller, means for severing the other web to define a leading edge, and means for pressing the undersurface of said other web onto said tape such that the leading edge of said other tape covers about half of the width of the tape thereby attaching the same to the other web and leaving about half the width uncovered; and (g) means for moving the grip rollers relative to each other so that the uncovered half of the tape and the one web are sandwiched between the grip rollers whereby the other web is spliced to the one web and moves therewith.

13. Apparatus according to claim 12, wherein said tape delivery device is constructed and arranged so that tape reel is movable in a direction perpendicular to the axes of the grip rollers to enable the tape to be unspooled over either of said grip rollers.

14. Apparatus comprising:

(a) a reel mounted on a frame;

(b) a web spooled on said reel and having a free end;

(c) a leader attached to the free end of said web;

(d) pressure-sensitive adhesive means on the leader form releasably attaching said leader to said web to prevent unspooling of the web on the reel;

(e) a leader tip nipping mechanism mounted on said frame and having a movable arm on which actuatable jaws are mounted;

(f) means for moving said arm to a position on which said jaws intercept said leader when said reel is rotated;

(g) means for actuating said jaws to grip said leader when it is intercepted by said jaw;

(h) means for unspooling said web from said reel after the leader is gripped by said jaws to form an open loop; and (i) means for moving said arm to a position at which the adhesive means on said leader is squeezed between the leader and the web to form a closed loop.

15. Apparatus according to claim 14, including a drawing out mechanism comprising:

(a) a rod mounted for movement in a direction parallel to the axis of the reel;

(b) an actuator for selectively moving said rod into said closed loop;

(c) means for moving said actuator and rod away from said reel to thereby unspool the web therefrom;

(d) a supplementary delivery system engageable by said closed loop for delivering the same to a guide mechanism;

(e) a cutter selectively operable to severe said web upstream of said closed loop to establish the leading edge of said web; and (f) said supplementary delivery system being constructed and arranged to engage said webs to move the leading edge on said guide mechanism.

16. Apparatus according to claim 15, including a tape delivery system effective to position the leading edge of said web on a tape oriented transversely to the direction of movement of said web in said guide mechanism, said web covering about one half of the width of the tape which has pressure-sensitive adhesive on one surface thereof in contact with said web.

* * * * *